United States Patent [19]

Tamura

[11] Patent Number: 4,622,466

[45] Date of Patent: Nov. 11, 1986

[54] PRESSURE VESSEL OF AN X-RAY DETECTOR

[75] Inventor: Hisaaki Tamura, Ootawara, Japan

[73] Assignee: Kabushiki Kaisha Toshiba, Kawasaki, Japan

[21] Appl. No.: 649,597

[22] Filed: Sep. 12, 1984

[30] Foreign Application Priority Data

Sep. 14, 1983 [JP] Japan ..... 58-170901

[51] Int. Cl.[4] ..... H01J 47/02

[52] U.S. Cl. ..... 250/374; 250/385

[58] Field of Search ..... 220/3; 250/374, 385 R, 250/370 I; 378/19

[56] References Cited

U.S. PATENT DOCUMENTS 3,207,352 9/1965 Reinhart, Jr. ..... 220/3
4,031,396 6/1977 Whetten et al. ..... 250/385
4,073,400 2/1978 Brook et al. ..... 220/453
4,417,144 11/1983 Hoffman et al. ..... 250/367

*Primary Examiner*—Janice A. Howell
*Assistant Examiner*—Constantine Hannaher
*Attorney, Agent, or Firm*—Finnegan, Henderson, Farabow, Garrett & Dunner

[57] ABSTRACT

A pressure vessel of an X-ray detector, in which the contamination and leakage of xenon gas contained in the detector is prevented. The pressure vessel of the invention comprises a container of a curved pillar shape with a window through which the X-ray passes. The container is made of a metal, and the window faces inward of the curvature of the container. A carbon fiber-reinforced plastic sheet is fixed to the inner wall of the periphery of the window to cover the window. An elastic insulation sheet is attached to the inside of the carbon fiber-reinforced plastic sheet so as to cover the window. A metal foil is attached to the inside of the elastic insulation sheet so as to cover the window.

4 Claims, 2 Drawing Figures

PRESSURE VESSEL OF AN X-RAY DETECTOR

BACKGROUND OF THE INVENTION

1. Field of the Invention

This invention relates to a pressure vessel of an X-ray detector, and more particularly, this invention relates to the structure of the window portion of a vessel of an X-ray detector.

2. Description of the Prior Art

X-ray detectors are used in computer-tomographs which are widely used in the medical field. The conventional X-ray detector of this kind comprises a container of a curved pillar shape. The container is usually made of an aluminum alloy. The container has a window facing the inside curvature of the container. X-rays from an object pass through the window. A carbon fiber-reinforced plastic (hereinafter referred to as CFRP) sheet is attached to the inner wall of the periphery of the window by means of an epoxy resin-based adhesive so as to gas-tightly cover the window. The container is filled with a gas such as xenon, which is opaque with respect to X-rays. The pressure of the gas in the container is usually 10 to 50 atms. The gas is ionized upon impingement of X-rays, and the intensity of the impinged X-rays is determined based on the degree of ionization of the gas. A plurality of parallel planar anodes and a plurality of parallel planar cathodes are alternately disposed in the container to form a number of cells. The intensity of the X-rays impinging on each cell is determined and computer-analyzed to form an image of an object.

Some conventional X-ray detectors further comprise an aluminum foil of about 50 μm thickness attached to the inside of the CFRP sheet. The aluminum foil serves to compensate for the brittleness of the CFRP sheet and to shut out an organic gas which may be generated from the CFRP upon impingement of X-rays. A contact potential difference arises between the CFRP sheet and the aluminum foil. The potential difference is increased by amine groups in a hardening agent in the epoxy resin-based adhesive. Due to the potential difference, the aluminum foil is corroded, so that thin through holes are formed in the foil. As a result, organic gas from the CFRP sheet diffuses into the container to contaminate the xenon gas in the container. As a result, the insulation property of the xenon gas is reduced, so that the detection accuracy is degraded.

SUMMARY OF THE INVENTION

Accordingly, the object of the present invention is to provide a pressure vessel of an X-ray detector in which the organic gas from the CFRP sheet is not diffused into the container.

The pressure vessel of the present invention comprises, like a conventional pressure vessel, a container of a curved pillar shape with a window through which the X-ray passes, the container being made of a metal, the window facing the center of the curvature. In the container is a gaseous medium substantially opaque to X-rays, which is ionized upon impingement of X-rays. The intensity of impinged X-rays is determined with respect to the degree of ionization of the gaseous medium. A CFRP sheet is fixed to the inner wall of the periphery of the window so as to provide a gas-tight covering on the window. An elastic insulation sheet such as an aromatic polyamide sheet is attached to the inside of the CFRP sheet so as to cover the window. A metal foil is attached to the inside of the elastic insulation sheet so as to cover the window.

In the pressure vessel of the present invention, the CFRP sheet and the metal foil is separated by the elastic insulation sheet, so that no contact potential difference is generated. As a result, corrosion of the metal foil is prevented.

DETAILED DESCRIPTION OF THE PREFERRED EMBODIMENTS

Figure 1:
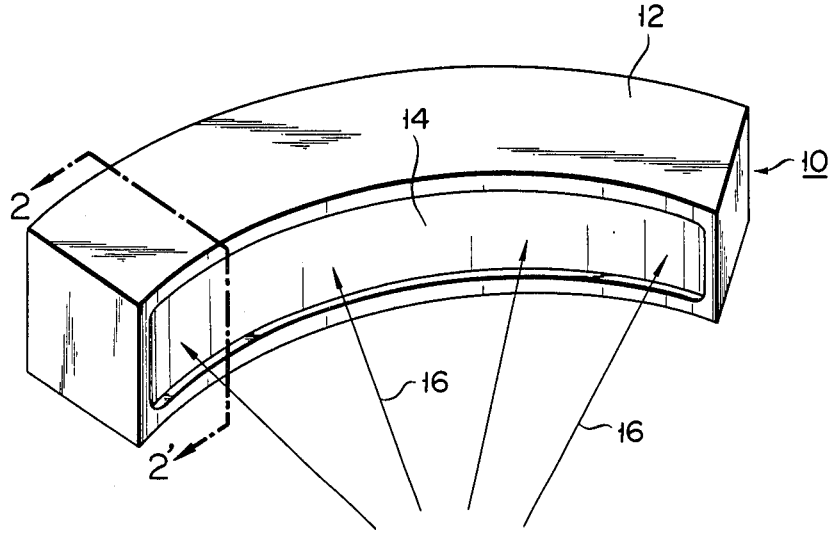
FIG. 1 shows a schematic perspective view of the pressure vessel of the present invention.

As shown in FIG. 1, the pressure vessel 10 of the present invention comprises, like a conventional pressure vessel, a container 12 of a curved pillar shape. The container 12 is usually made of an aluminum alloy, but is not limited to it. The container 12 has a window 14 facing inward relative to the curvature of the container 12 as shown in FIG. 1. X-rays 16 from an object (not shown) pass through the window 14. A CFRP sheet which is well-known in the art is fixed to the inner wall of the periphery of the window 14 by means of, e.g., an epoxy resin-based adhesive, so as to provide a gas-tight covering for the window. The thickness of the CFRP sheet may be 2 mm to 5 mm. A gas such as xenon which is opaque with respect to the X-ray is filled into the container 12. The pressure of the gas in the container 12 is usually 10 to 50 atms. A plurality of parallel planar anodes and a plurality of parallel planar cathodes (not shown) are alternately disposed in the container to form a number of cells. The intensity of the X-rays impinging on each cell is determined and computer-analyzed to form the image of an object.

Figure 2:
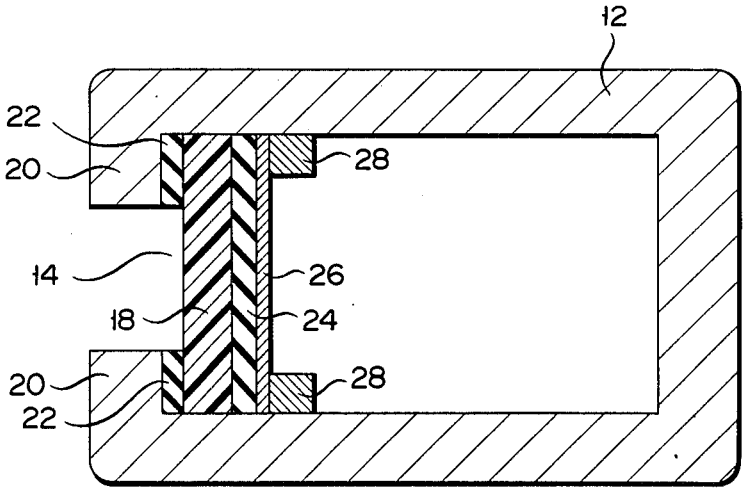
FIG. 2 shows an enlarged sectional view taken along the 2—2' line in FIG. 1.

The above-described structure is the same as that of conventional pressure vessels. The window portion of the pressure vessel of the present invention will now be described in detail referring to FIG. 2. The CFRP sheet 18 is fixed to the inner wall of the periphery 20 of the window 14, preferably through an elastic insulation strip 22 such as an aromatic polyamide (polyaramide) which will be described in more detail. The thickness of the elastic insulation strip 22 is, for example, 10 μm to 100 μm. By providing an elastic insulation strip between the CFRP sheet 18 and the inner wall of the periphery 20 of the window 14, the contact therebetween is prevented, so that the corrosion of the aluminum periphery 20 of the window 14 is prevented. As a result, the possible leakage of the xenon gas contained in the container 12 is prevented. An elastic insulation sheet 24 is attached to the inside of the CFRP sheet 18 so as to cover the window 14. The thickness of the elastic insulation sheet is, for example, 10 μm to 100 μm. A metal foil 26 such as aluminum, beryllium or titanium foil is attached to the inside of the elastic insulation sheet 24. The thickness of the metal foil 26 may be 5 μm to 50 μm. The metal foil 26 serves to shut out an organic gas which is generated from the CFRP sheet 18 when X-rays impinge on the CFRP sheet 18. A fixing frame 28 urges the layered structure consisting of the metal foil 26, elastic insulation sheet 24, CFRP sheet 18 and elastic insulation film 22 against the inner wall of the periphery 20 of the window 14.

As the elastic insulation sheet 24 and the elastic insulation strip 22, any material which is more or less elastic and which can insulate electricity can be used. However, from the viewpoint of strength and elasticity, aromatic polyamide (polyaramide) sheet is especially preferred. The aromatic polyamide sheet herein means a fabric and an unwoven fabric comprising aromatic polyamide fibers. In order to reinforce the fabrics, they are usually embedded in a matrix of, e.g., epoxy resin, phenol resin or polyester resin to form sheets. The fabrics comprising aromatic polyamide fibers, which are embedded in a matrix are also included in the definition of "aromatic polyamide sheet". Such an aromatic polyamide sheet is sold by E.I. DU PONT DE NEMOURS & COMPANY (INC.) under the tradename of Kevlar. When Kevlar is embedded in an epoxy resin matrix, its rigidity is as high as aluminum and its elasticity is higher than that of aluminum. Thus, by using the aromatic polyamide sheet such as Du Pont Kevlar as the elastic insulation sheet 24, besides the prevention of the corrosion of the metal foil 26, the reinforcement of the window structure is accomplished. If the sheet is subjected to a radiation treatment or to a stretching treatment in accordance with the well-known conventional methods, the strength of the sheet is further increased. Other than the aromatic polyamide sheet, a polyurethane sheet, polyimide sheet or phenol resin sheet (such as Bakelite a trademark for various resins and plastics manufactured by Union Carbide Corp.) can be used as the elastic insulation sheet.

The pressure vessel of the present invention can be assembled as follows.

First, on the inner wall of the periphery 20 of the window 14, the elastic insulation film 22, the CFRP sheet 18, the elastic insulation sheet 24 and the metal foil 26 are stacked in the order mentioned. The fixing frame 28 is then screwed on the container 12 such that it presses or urges the layered structure against the inner wall of the periphery 20 of the window 14. Under these conditions the whole pressure vessel is subjected to a heat treatment of 80° to 160° C. By so doing, the epoxy resin matrices of the elastic insulation sheet 24 and 22 are melted to some degree. After cooling the pressure vessel, the melted matrices are solidified and the matrices act as an adhesive to connect the layers of the layered structure with each other. If the elastic insulation sheet 24 and elastic insulation strip 22 are subjected to a well-known corona discharge treatment, chromic acid treatment, or alkali treatment, the adhesivity of the insulation sheet is further promoted.

What is claimed is:

1. A pressure vessel of an X-ray detector in which a high pressure gaseous medium substantially opaque to X-rays is contained, the gaseous medium being ionized upon impingement of X-rays, the intensity of impinged X-rays being determined based on the degree of ionization of the gaseous medium, the pressure vessel comprising:

a container of a curved pillar shape with a window through which the X-ray passes, the container being made of a metal, the window facing the center of the curvature;

a carbon fiber-reinforced plastic sheet fixed in the container to cover the window;

a polyaramide sheet attached to the inside of the carbon fiber-reinforced plastic sheet to cover the window; and a metal foil attached to the inside of the polyaramide sheet to cover the window.

2. The pressure vessel of claim 1, further comprising a fixing frame fixed in the container so as to urge the peripheral portions of the layered carbon fiber-reinforced plastic sheet, polyaramide sheet and metal foil against the inner wall of the periphery of the window.

3. The pressure vessel of claim 1, further comprising an elastic insulation film disposed between the carbon fiber-reinforced plastic sheet and the periphery of the window.

4. The pressure vessel of claim 1, wherein the metal foil is made of a material selected from the group consisting of aluminum, beryllium and titanium.

* * * * *